US005178826A

United States Patent [19]

Fessel et al.

[11] Patent Number: 5,178,826

[45] Date of Patent: Jan. 12, 1993

[54] METHOD AND APPARATUS FOR THE PRODUCTION OF NODULAR OR COMPACTED GRAPHITE IRON CASTINGS

[75] Inventors: Manfred Fessel, Rhede; Wilfried Eisenacher, Borken, both of Fed. Rep. of Germany

[73] Assignee: Foseco International Limited, Birmingham, England

[21] Appl. No.: 879,881

[22] Filed: May 7, 1992

[30] Foreign Application Priority Data

Jun. 1, 1991 [GB] United Kingdom ..... 9111804

[51] Int. Cl.[5] ..... B22D 23/00

[52] U.S. Cl. ..... 420/20; 164/271

[58] Field of Search ..... 420/19-22; 164/271

[56] References Cited

U.S. PATENT DOCUMENTS

| | | | |
|---|---|---|---|
| 3,765,876 | 10/1973 | Moore | 420/20 |
| 3,870,512 | 3/1975 | Lee | 420/20 |
| 3,965,962 | 6/1976 | Tanaka | 420/22 |
| 4,134,757 | 1/1979 | Roberts | 420/20 |
| 4,210,195 | 7/1980 | McPherson | 420/20 |
| 4,337,816 | 7/1982 | Kaku | 420/20 |
| 4,396,428 | 8/1983 | Linebarger | 420/22 |

*Primary Examiner*—Peter D. Rosenberg
*Attorney, Agent, or Firm*—Nixon & Vanderhye

[57] ABSTRACT

A method for producing nodular or compacted graphite iron castings in a mould having a sprue, an ingate and a mould cavity, having a first part below and a second part above the level of the ingate, comprises delivering particulate magnesium-containing and silicon-containing treatment agent from a dispenser into a stream of molten metal entering the sprue such that the treatment agent is added at a constant rate of addition while the first part of the mould cavity is filled with iron, and at a decreasing rate while the second part is filled. The addition of the treatment agent is controlled by means of apparatus comprising a container, a measuring and data capture device connected via signal transforming means to a control means, conveyor means located below the container and connected to the signal transforming means, and means for injecting the particulate treatment agent into the metal stream.

8 Claims, 1 Drawing Sheet

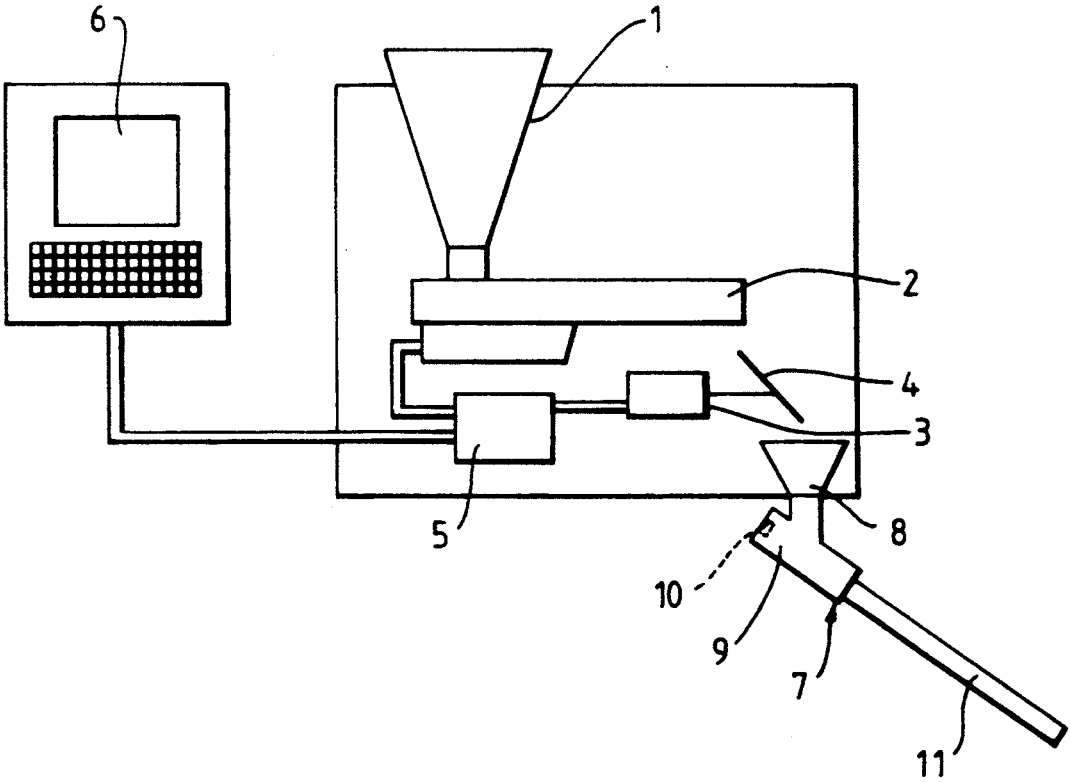
6
1
2
4
3
5
8
10
9
7
11

METHOD AND APPARATUS FOR THE PRODUCTION OF NODULAR OR COMPACTED GRAPHITE IRON CASTINGS

This invention relates to a method and apparatus for the production of nodular or compacted graphite iron castings, and it will be described with particular reference to the casting of nodular graphite iron.

Nodular graphite iron (also known as ductile iron or spheroidal graphite iron), is iron in which the graphite is present as nodules or spheroids. In compacted graphite iron (also known as vermicular graphite iron or quasi-flake graphite iron) the form of the graphite is intermediate between the flake graphite form of grey cast iron and the nodular form of nodular iron.

Nodular iron is commonly produced by treating molten iron with magnesium. Small amounts of rare earths are often added in combination with magnesium. Rare earths and elements such as calcium and yttrium which are capable of producing nodular graphite are seldom used on their own.

All the above mentioned elements are easily oxidised and magnesium is particularly difficult to handle because it boils at a temperature of a little above 1100° C. while the normal casting temperature for molten iron is about 1400° C.

Particular magnesium-containing alloys used for magnesium treatment are for example a 5–10% by weight magnesium-containing ferrosilicon for overpouring and 20–40% by weight magnesium-containing ferrosilicon for plunging. Coke impregnated with pure magnesium is used for plunging and special treatment vessels and processes are also used for treatment with pure magnesium or with special alloys.

All these methods have in common the fact that the magnesium treatment must be carried out at temperatures which are substantially above the desired casting temperature. Normally the treatment temperature is about 1500° C.

Furthermore, it is common to all these methods, that the magnesium treated iron must be inoculated either in the treatment ladle or directly in the metal stream during the pouring of individual moulds or in the mould in order to form the nuclei in the cast metal which are necessary to avoid the formation of undesirable white iron structures.

During the process of rationalisation and improving the working environment within foundries over the course of the last ten or so years, many mechanised or automatic pouring units have been brought into use. Holding magnesium treated iron in such heated or unheated pouring units has resulted in particular problems namely:

a) an excessive loss of magnesium from the molten iron
b) build-up of magnesium reaction products in the pouring unit. For this reason cleaning and/or renewal of the refractory lining is necessary at frequent intervals
c) the regulation of a consistent level of inoculation is difficult and it is only possible to inoculate accurately in the pouring stream whilst pouring individual moulds.

In British Patents Nos. 1 278 265 and 1 511 246 a method is described for the treatment of iron in the mould with magnesium. In this method a nodularising agent is introduced into the mould in one or more intermediate chambers. This method only provides a solution to the problems listed under a) and b) above.

The major disadvantages of this method are the poor utilisation of the available mould area leading to a poor yield of casting from a given mould and the poor adaptability of the method to variable process conditions such as temperature and sulphur content. The poor utilization of the mould area is due to the need for additional reaction chambers; an adjustment is only possible by changing the running system.

British patent specification No. 1 527 054 describes a process for injecting powdered or granular ferrosilicon-magnesium alloys into the pouring system. It has been shown that the process which has been described is not industrially applicable and yields, even under experimental conditions, only by chance sufficient residual magnesium and therefore spheroidal graphite. Furthermore, a number of factors such as the chemical composition of the alloy, the dependence of the magnesium recovery on the alloy grading and the type and dimensions of the running system need to be considered.

European patent Application No. 0 347 052 describes a mould and process for the production of nodular graphite or compacted graphite iron castings in which a magnesium-containing and silicon-containing treatment agent is added from a dispenser to a stream of molten iron in the sprue of the mould. The mould contains a ceramic filter and the various parts of the mould have a defined relationship one with another, and the particle size of the treatment agent is controlled so that it is within the range of from 0.2 mm to 4 mm.

In European Patent Application No. 0 347 052 the dispenser which is used to deliver the treatment agent into the stream of molten iron may be for example apparatus of the type described in British Patent Application No. 2 024 029A. That apparatus has a nozzle which is connected to a source of compressed air or an inert gas, means for feeding a treatment agent into the flow of gas from the nozzle and a detector which senses the presence and absence of a stream of molten metal lying in the path of the flow of gas and treatment agent. The detector controls the flow of treatment agent in such a manner that when the stream of molten metal is present the flow of the treatment agent is caused to start and when the molten metal stream ceases the flow of treatment agent is automatically stopped.

The apparatus which was developed as a means of achieving metal stream inoculation of molten iron, dispenses fine granular inoculating agents at a constant flow rate from the commencement to the end of casting.

In practice it has been found that the use of such apparatus for dispensing a treatment agent for producing nodular graphite iron as described in EP 0 347 052 can lead to a variable distribution of magnesium and silicon in a casting due to the fact that the addition rate of the treatment agent is constant throughout the casting process. As a result castings which do not contain all the graphite in the nodular form can be produced and the castings have variable mechanical properties.

EP 0 347 052 also states that a preferred apparatus for dispensing the treatment agent also has means for adjusting the rate of flow of the treatment agent so that throughout pouring the required amount of treatment agent is always delivered to the molten stream.

It has now been found that nodular graphite or compacted graphite iron castings can be produced in a reliable and satisfactory manner if the treatment agent flows at a constant rate while that part of the mould cavity which is below the ingate is filling, and at a decreasing rate while that part of the mould cavity is above the ingate is filling.

According to the invention there is provided a method for the production of a nodular or compacted graphite iron casting in a mould having a sprue, an ingate and a mould cavity, a first part of the mould cavity being located below the level of the ingate and a second part of the mould cavity being located above the level of the ingate, the method comprising delivering a particulate magnesium-containing and silicon-containing treatment agent from a dispenser into a stream of molten iron entering the sprue in such a manner that the treatment agent is added at a constant rate of addition while the first part of the mould cavity is being filled with molten iron, and at a decreasing rate of addition while the second part of the mould cavity is being filled with molten iron, so that the molten iron is treated with the treatment agent and on solidification of the iron in the mould cavity a nodular or compacted graphite iron casting is produced.

According to a further feature of the invention there is provided apparatus for use in the method described in the paragraph above the apparatus comprising a container for holding a particulate treatment agent, a measuring and data capture device connected via a signal transforming means to a control means, conveyor means located below the container and connected to the signal transforming means, and means for injecting the particulate treatment agent into a stream of molten metal.

In a preferred embodiment of the apparatus of the invention the container is a hopper, and the measuring and data capture device is a device of the type described in German Patent Application Publication No. 3410845 having an inclined plate on to which the particulate treatment agent falls and which is connected to means for continuously weighing the amount of particulate treatment agent falling on to the plate. A conveyor means such as a vibrating channel collects the particulate treatment agent from the container. The particles then fall from the conveyor means on to the inclined plate from which they are transferred to the injection means for injecting the particles into the molten metal stream.

When molten metal starts to flow the control means receives a signal from the vessel containing the metal, for example, from a stopper which is raised to release the molten metal. The control means, which is programmed according to the calculations described below, then continuously calculates the quantity of metal which is flowing, and also calculates the quantity of treatment agent required at a particular instant, and sends this information to the signal transforming means.

The particulate treatment agent flow rate data from the measuring and data capture device is transferred to the signal transforming means which also receives information from the control means as to the required flow rate of particulate treatment agent. If there is a discrepancy between the two the signal transforming means will automatically alter the flow rate of the particles in the conveyor means.

The control means, for example a microprocessor, is programmed so as to ensure that during filling of the part of the mould cavity which is below the ingate a constant amount of treatment agent is fed to the metal stream, and during filling of the part of the mould cavity which is above the ingate a decreasing amount of treatment agent is fed to the metal stream.

The means for injecting the particulate treatment agent into a stream of molten metal is preferably a device similar to that described in British Patent Application No. 2024029A consisting of a funnel, a mixing chamber, a delivery tube and a nozzle. The particles of treatment agent fall under gravity into the funnel and they are mixed in the mixing chamber with air or inert gas admitted through the nozzle. The particles are thus accelerated down the delivery tube and into the stream of molten metal. Depending on the type of mould a vertical cylinder or alternatively a horizontal half cylinder may be used as the theoretical model on which the required flow rates for the treatment agent may be calculated.

For filling that part of the mould cavity which is below the level of the mould cavity ingate the weight of iron flowing per second $$m_0 = \frac{V1 \cdot c}{t_1}$$

the volume $$V1 = \frac{GF4}{c}$$

and the pouring time $$t_1 = \frac{V1}{\sqrt{2g \cdot HF2 \cdot R \cdot FF9}}$$

where

R = coefficient of friction c = density of the cast metal

GF4 = weight of casting below the level of the ingate

FF9 = cross-sectional area of the ingate g = acceleration due to gravity and HF2 = height of cast column above the level of the ingate.

For filling that part of the mould cavity which is above the ingate using the horizontal half cylinder as the theoretical model the weight of iron flowing per second $$m = \frac{Vm \cdot c}{tm}$$

the length of the half cylinder $$Vm = \frac{2 - HF3^2 \cdot \sqrt{1 - (m/n)^2} \cdot L}{n}$$

the volume of the mth slice $$tm = \frac{Vm}{\sqrt{2g \cdot h \cdot R \cdot FF9}} \text{ where}$$

$$h = HF2 - \frac{m \cdot HF3}{n} \text{ and}$$

$$V2 = \frac{GF5}{c}$$

and the pouring time of the mth slice $$L = \frac{2 \cdot V2}{HF3^2 \cdot \pi}$$

where HF3 is the height of the pattern above the level of the ingate, where n is the total number of slices and m is any number between 1 and n, GF5 is the weight of casting above the level of the ingate, and the other symbols are as indicated above.

When a vertical cylinder is used as the theoretical model the weight of iron flowing per second $$m_1 = \frac{Vm_1 \cdot c}{tm_1}$$

the base surface area of the cylinder $$FF0 = \frac{V2}{HF3}$$

the volume per slice $$Vm_1 = FF0 \cdot \frac{HF3}{n}$$

and the pouring time of the mth slice $$tm_1 = \frac{Vm_1}{\sqrt{2g \cdot h} \cdot R \cdot FF9}$$

where $$h = HF2 - \frac{m \cdot HF3}{n}$$

and $$V2 = \frac{GF5}{c}$$

where each of the symbols is as indicated above.

The actual quantity of treatment agent required at any point in time can be calculated by multiplying $m_0$, m or $m_1$ by the desired percentage addition.

In a preferred embodiment of the method of the invention the iron is cast in a mould having a treatment sprue, a runner, a slag trap, a filter chamber having an ingate and an outlet and having located therein a ceramic filter having an inlet and an outlet, a casting cavity ingate, and a casting cavity and the parts of the mould have a relationship one with another as defined in European Patent Application No. 347052. More preferably the vertical cross-sectional area of the runner is equal to the cross-sectional area of the ingate of the filter chamber.

The particulate treatment agent used in the method and apparatus of the invention is preferably a magnesium-containing and silicon-containing treatment agent having a particle size of 0.4 mm to 2 mm.

The invention is illustrated with reference to the accompanying drawing which is a diagrammatic representation of apparatus according to the invention.

Referring to the drawing apparatus for adding a particulate treatment agent to a stream of molten iron in the production of nodular iron or compacted graphite iron castings consists of a hopper 1 which holds the particulate treatment agent, a vibrating channel conveyor 2, a measuring and data capture device 3 having an inclined plate 4, a signal transformer 5, a microprocessor 6, and a device 7 for injecting the particulate treatment agent into a stream of molten metal. The injector device 7, which is part of the apparatus described in British Patent Application No. 2024029A, the remainder of which is not shown, consists of a funnel 8, a mixing chamber 9 having a nozzle 10 for admitting compressed air, and a delivery tube 11.

In use, when flow of molten iron commences, the microprocessor 6 receives a signal from the vessel containing the molten iron (not shown) and then calculates continuously the amount of iron which is flowing.

Particulate treatment agent falls from the hopper 1 on to the vibrating channel conveyor 2 which is connected to the signal transformer 5. The particulate treatment agent passes along the conveyor 2 and falls on to the inclined plate 4 and from there into the injector device 7. The measuring and data capture continuously weighs and records the amount of particulate treatment agent falling on to the inclined plate 4 and transmits the recorded data to the signal transformer 5. The microprocessor 6 is programmed so as to determine the amount of particulate treatment agent required at any instant in time based on the quantity of iron which is flowing and the desired percentage addition rate of the treatment agent, and continuously transmits to the signal transformer 5 information on the required amount of treatment agent. If the actual flow of treatment agent as determined by the measuring and data capture device 3 is incorrect the signal transformer 5 will correct the flow of treatment agent in the vibrating channel conveyor 2.

The particulate treatment agent falls through the funnel 8 of the injection device 7 into the mixing chamber 9 and is mixed with compressed air entering through the nozzle 10 and accelerated down the delivery tube 11 into the stream of molten metal entering a mould.

The microprocessor 6 controls the flow of treatment agent in the manner described above, such that while the part of the casting cavity of the mould which is below the level of the ingate is filling with iron the particulate treatment agent flows at a constant rate, and while the part of the mould cavity which is above the level of the ingate is filling the particulate treatment agent flows at a decreasing rate.

The invention is further illustrated in the following comparative example.

Two identical bearing housing castings, symmetrical about one axis of rotation, were produced in nodular iron using the apparatus shown in the accompanying drawing (Example 1), and two further examples of the same casting were produced using only the apparatus described in British Patent Application No. 2024029A (Example 2).

The casting had a weight of 77 kg and a total height of 250 mm. In Example 1 the total addition per mould of magnesium-containing and silicon-containing treatment agent which was adapted to the actual amount of iron flowing was 1066 g. In Example 2 1054 g of the same treatment agent was added to each mould at a constant rate of 50 g/sec over approximate 21 seconds.

The magnesium and silicon contents were determined in all the castings at various points, and the means value and standard deviation from the mean was calculated.

The following results were obtained.

EXAMPLE 1

| Magnesium | | | | | |
|---|---|---|---|---|---|
| Casting 1 | | | Casting 2 | | |
| Top | Center | Bottom | Top | Center | Bottom |
| 0.023% | 0.024% | 0.023% | 0.023% | 0.023% | 0.022% |
| 0.022% | 0.023% | 0.021% | 0.022% | 0.024% | 0.021% |
| 0.022% | 0.022% | 0.021% | 0.023% | 0.023% | 0.023% |
| 0.023% | 0.023% | 0.021% | 0.022% | 0.024% | 0.022% |

Mean (x) = 0.0225%
Standard deviation (s) = 0.000933%
x +/− 3s = 0.0197% to 0.0253%

| Silicon | | | | | |
|---|---|---|---|---|---|
| Casting 1 | | | Casting 2 | | |
| Top | Center | Bottom | Top | Center | Bottom |
| 2.22% | 2.25% | 2.18% | 2.22% | 2.20% | 2.15% |
| 2.20% | 2.17% | 2.17% | 2.21% | 2.26% | 2.14% |
| 2.21% | 2.19% | 2.19% | 2.24% | 2.28% | 2.20% |
| 2.24% | 2.20% | 2.17% | 2.20% | 2.26% | 2.18% |

Mean (x) = 2.205%
Standard deviation (s) = 0.00358%
x +/− 3s = 2.098% to 2.312%

EXAMPLE 2

| Magnesium | | | | | |
|---|---|---|---|---|---|
| Casting 1 | | | Casting 2 | | |
| Top | Center | Bottom | Top | Center | Bottom |
| 0.023% | 0.022% | 0.020% | 0.023% | 0.023% | 0.020% |
| 0.022% | 0.023% | 0.019% | 0.021% | 0.022% | 0.020% |
| 0.022% | 0.023% | 0.019% | 0.023% | 0.022% | 0.019% |
| 0.022% | 0.022% | 0.017% | 0.022% | 0.022% | 0.020% |

Mean (x) = 0.0213%
Standard deviation (s) = 0.001654%
x +/− 3s = 0.0163% to 0.0263%

| Silicon | | | | | |
|---|---|---|---|---|---|
| Casting 1 | | | Casting 2 | | |
| Top | Center | Bottom | Top | Center | Bottom |
| 2.20% | 2.35% | 2.18% | 2.31% | 2.29% | 2.18% |
| 2.26% | 2.35% | 2.24% | 2.24% | 2.34% | 2.23% |
| 2.30% | 2.28% | 2.21% | 2.23% | 2.27% | 2.19% |
| 2.26% | 2.31% | 2.15% | 2.33% | 2.30% | 2.20% |

Mean (x) = 2.267%
Standard deviation (s) = 0.0575%
x +/− 3s = 2.090% to 2.435%.

In Example 2 which is not according to the invention the rate of flow rate of the molten iron into the mould at the beginning of pouring was about 4.5 kg of iron per second and about 2.5 kg of iron per second at the end of pouring. As flow rate of the treatment agent was constant at 50 g/sec the actual addition rate based on the weight of iron was 1.11% at the beginning and 2.00% at the end.

In example 1 the rate of addition of treatment agent was controlled by the apparatus of the invention so that the amount added while the part of the mould cavity which is below the ingate was filling was constant and the amount added while the part of the mould cavity which is above the ingate was filling was decreasing.

A comparison of the results obtained shows that the standard deviations for magnesium and silicon content at a constant rate of addition of the treatment agent are respectively 77% and 60% higher than when the rate of addition is as required by the process of the invention. Furthermore even though the actual amount of treatment agent is virtually the same in both examples compacted graphite was found in part of the castings of Example 2 while the castings of Example 1 contained 100% nodular graphite.

We claim

1. A method for the production of a nodular or compacted graphite iron casting in a mould having a sprue, an ingate and a mould cavity, a first part of the mould cavity being located below the level of the ingate and a second part of the mould cavity being located above the level of the ingate, the method comprising delivering a particulate magnesium-containing and silicon-containing treatment agent from a dispenser into a stream of molten iron entering the sprue, in such a manner that the treatment agent is added at a constant rate of addition while the first part of the mould cavity is being filled with molten iron, and at a decreasing rate of addition while the second part of the mould cavity is being filled with molten iron, so that the molten iron is treated with the treatment agent and on solidification of the ion in the mould cavity a nodular or compacted graphite iron casting is produced.

2. A method according to claim 1 wherein the iron is cast in a mould having a runner, a slag trap and a filter chamber having an ingate and an outlet and having located therein a ceramic filter having an inlet and an outlet and the vertical cross-sectional area of the runner is equal to the cross-sectional area of the ingate of the filter chamber.

3. A method according to claim wherein the magnesium-containing and silicon-containing treatment agent has a particle size of 0.4 mm to 2 mm.

4. Apparatus for use in a method for the production of a nodular or compacted graphite iron casting in a mould having a sprue, an ingate and a mould cavity, a first part of the mould cavity being located below the level of the ingate and a second part of the mould cavity being located above the level of the ingate by delivering a particulate magnesium-containing and silicon-containing treatment agent from a dispenser into a stream of molten iron entering the sprue in such a manner that the treatment agent is added at a constant rate of addition while the first part of the mould cavity is being filled with molten iron, and at a decreasing rate of addition while the second part of the mould cavity is being filled with molten iron, said apparatus comprising a container for holding a particulate treatment agent, a measuring and data capture device connected via a signal transforming means to a control means, conveyor means located below the container and connected to the signal transforming means, and means for injecting the particulate treatment agent into a stream of molten metal.

5. Apparatus according to claim 4 wherein the container is a hopper and the measuring and data capture device has an inclined plate on to which the particulate treatment agent falls and which is connected to means for continuously weighing the amount of particulate treatment agent falling on the plate.

6. Apparatus according to claim 4 wherein the conveyor means is a vibrating channel.

7. Apparatus according to claim 4 wherein the control means is a microprocessor.

8. Apparatus according to claim 4 wherein the means for injecting the particulate treatment agent into the stream of molten metal consists of a funnel, a mixing chamber, a delivery tube and a nozzle.

* * * * *

UNITED STATES PATENT AND TRADEMARK OFFICE
CERTIFICATE OF CORRECTION

PATENT NO. : 5,178,826

DATED : January 12, 1993

INVENTOR(S) : Fessel et al

It is certified that error appears in the above-identified patent and that said Letters Patent is hereby corrected as shown below:

The formula at the top of column 5, $L = \frac{2.V2}{HF3^2.\pi}$ should appear immediately below "the length of the half cylinder" in line 52 of column 4;

The formula at line 55 of column 4, $$Vm = \frac{2 - HF3^2.\sqrt{1 - (m/n)^2}.L}{n},$$

should appear immediately below "the volume of the mth slice" in line 58 of column 4;

And "the pouring time of the mth slice" in line 68 of column 4 should appear immediately above the formula, $$tm = \frac{Vm}{\sqrt{zg \cdot h} \cdot R \cdot FF9}$$

at line 60 of column 4.

Signed and Sealed this

Eighteenth Day of January, 1994

*Attest:*

Bruce Lehman

BRUCE LEHMAN

*Attesting Officer*

*Commissioner of Patents and Trademarks*